US010161221B2

(12) United States Patent
Mills et al.

(10) Patent No.: US 10,161,221 B2
(45) Date of Patent: Dec. 25, 2018

(54) DUAL VACUUM INSULATED TUBING WELL DESIGN

(71) Applicant: CONOCOPHILLIPS COMPANY, Houston, TX (US)

(72) Inventors: James A. Mills, Houston, TX (US); Robert S. Redman, Anchorage, AK (US); David L. Lee, Anchorage, AK (US)

(73) Assignee: ConocoPhillips Company, Houston, TX (US)

( * ) Notice: Subject to any disclaimer, the term of this patent is extended or adjusted under 35 U.S.C. 154(b) by 646 days.

(21) Appl. No.: 14/557,709

(22) Filed: Dec. 2, 2014

(65) Prior Publication Data

US 2015/0198012 A1 Jul. 16, 2015

Related U.S. Application Data

(60) Provisional application No. 61/911,378, filed on Dec. 3, 2013.

(51) Int. Cl.
*E21B 36/00* (2006.01)
*E21B 43/24* (2006.01)

(52) U.S. Cl.
CPC ..... *E21B 36/003* (2013.01); *E21B 43/2406* (2013.01)

(58) Field of Classification Search
None
See application file for complete search history.

(56) References Cited

U.S. PATENT DOCUMENTS

| | | | | |
|---|---|---|---|---|
| 3,397,745 | A | 8/1968 | Owens et al. | |
| 3,720,267 | A | 3/1973 | Allen et al. | |
| 4,512,721 | A | 4/1985 | Ayres et al. | |
| 5,025,862 | A * | 6/1991 | Showalter | E21B 36/00 138/114 |
| 5,607,901 | A * | 3/1997 | Toups, Jr. | C09K 8/34 166/356 |
| 5,862,866 | A * | 1/1999 | Springer | E21B 17/00 166/380 |
| 7,677,272 | B2 | 3/2010 | Hickman et al. | |
| 7,854,236 | B2 | 12/2010 | Jibb et al. | |
| 2009/0014163 | A1 * | 1/2009 | Thomas | F16L 53/002 165/154 |
| 2010/0200237 | A1 * | 8/2010 | Colgate | E21B 36/003 166/302 |

* cited by examiner

*Primary Examiner* — Caroline N Butcher
(74) *Attorney, Agent, or Firm* — Boulware & Valoir

(57) ABSTRACT

A method and system for insulating wells using dual concentric vacuum insulated tubing layers with joints staggered with respect to one another. The method can be combined with other insulating methods, and well as with other subsidence mitigation techniques.

17 Claims, 9 Drawing Sheets

SAGD PILOT
AFTER 3 YEARS

SAGD PILOT
AFTER 18 YEARS

THAW BULB RADIUS AFTER
18 YEARS

SINGLE VIT STRING

DUAL VIT STRINGS

| | FULLY THAWED | PARTIALLY THAWED |
|---|---|---|
| PRODUCER | ——— | - - - - - |
| INJECTOR | ▬▬▬ | ▬ ▬ ▬ |

DUAL VACUUM INSULATED TUBING WELL DESIGN

PRIOR RELATED APPLICATIONS

This application is a non-provisional application which claims benefit under 35 USC § 119(e) to U.S. Provisional Application Ser. No. 61/911,378 filed Dec. 3, 2013, entitled "Dual Vacuum Insulated Tubing Well Design," which is incorporated herein in its entirety.

FIELD OF THE INVENTION

The invention relates to well configurations for use in areas of permafrost, such as Alaska and Siberia, and other areas where temperature control is a concern.

BACKGROUND

According to the US Geological Survey estimates, the Arctic region, mostly offshore, holds as much as 25% of the world's untapped reserve of hydrocarbons. Therefore, petroleum producers have shown significant interests in exploring oil and gas reserves in Arctic regions, particularly with the depletion of conventional hydrocarbon reservoirs. The areas of interest for oil and gas production mainly include Barents Sea, the Russian arctic, onshore Russia, Chukchi Sea, Beaufort Sea, the Canadian arctic islands, northern Canada, and the east coast of Greenland.

Arctic areas are typically overlain by substantial permafrost layers on the order of 150 to 500 meters thick, which can be continuous from the surfaces, or discontinuous with intermittent unfrozen zones. To mobilize cold hydrocarbon deposits, heat is added to the reservoir until the hydrocarbons are fluid enough to be pumped to the surface. Commonly used in situ extraction thermal recovery techniques include a number of steam-based heating methods, such as steam flooding or steam drive (SD), cyclic steam stimulation (CSS) or "huff-and-puff", and Steam Assisted Gravity Drainage (SAGD), as well as various derivatives of these techniques.

SAGD is the most extensively used enhanced oil recovery technique for in situ recovery of bitumen resources in the McMurray Formation in the northern Alberta oil sands and other reservoirs containing viscous hydrocarbons. In a typical SAGD pattern, two horizontal wells are vertically spaced by 4 to 10 meters (m). The production well is located near the bottom of the pay and the steam injection well is located directly above and parallel to the production well. In SAGD, steam is injected continuously into the injection well, where it rises in the reservoir and forms a steam chamber. The heat from the steam reduces the oil's viscosity, thus enabling it to flow down to the production well and transported to the surface via pumps or lift gas.

As its name implies, generation of high quality, high temperature and high pressure steam is a prerequisite for the SAGD process. Specifications for the steam used for SAGD are 100% quality, 7,000-11,000 kPa pressure and 238° C.-296° C. temperature. Steam capacity (flowrate) is determined by the steam-to-oil (SOR) ratio which normally ranges around 2~4. Considering oil production volume (10,000~100,000 BPD depending on the well size), water requirement for steam generation is immense and the cost to create high quality steam is also highly significant.

As the steam is being transported to the payzone, heat is lost, causing the permafrost around the well to melt and resulting in settling of the soils due to the thaw. Thaw settlement becomes significant when steam carrying wells increase the temperature of surrounding soil and create a permafrost thaw bulb (see e.g., FIG. 1), thus reducing load carrying capacity of the soil and damaging surface structures. Permafrost thawing may have even more significant effects if areas of low thaw settlement (sands and gravels) are adjacent to areas sensitive to settlement (silts and clays), creating differential settlement. This differential settlement overstresses the well tubing and induces pipe bending strain and can result in loss of a well. As most thermal development takes place on pads, over time the thaw bulbs propagated from a single well can coalesce and form a thaw slot. Thaw slots introduce additional stresses, which can accelerate damage to the wells.

Methods to limit heat loss from wellbores have included the use of gelled diesel or insulated packer fluids in an annulus and/or using cement with higher thermal insulation properties. However, these methods have been less than satisfactory.

Another method of limiting heat loss uses vacuum insulated tubing (VIT), a typical sample of a VIT with partial cutaway is shown in FIG. 2. Vacuum insulated tubing has been widely used to limit heat loss from a wellbore, but its effectiveness has been limited, primarily due to the couplings. Couplings are a hot spot in that they do not have the same insulation properties as the main body of the joint. Accelerated heat loss can also happen when single or multiple joints of VIT lose their vacuum properties and lose heat close to the rate of a regular joint of tubing.

Thus, what are needed in the art are better methods of insulating wellbores in the Artic regions and other areas where temperature control is a concern.

SUMMARY OF THE DISCLOSURE

This disclosure provides a well configuration to limit heat transfer and the damage that can result thereby. Generally speaking, the concept requires using not only VIT but also a concentric ring of VIT intermediate casing (VIC) through the permafrost zone. In other words, the well is completed with dual concentric vacuum insulated tubulars. Without some method of reducing heat loss, it is unlikely that thermal developments in Arctic regions will be initiated due to the risk of melting permafrost and subsequent subsidence. The ability to limit heat loss to the permafrost is thus an enabling technology, advancing thermal recovery methods in the Arctic. Further, although specifically designed for Artic use, the inventive well completion configuration can be used anywhere where heat transfer is an issue.

A dual vacuum insulated string reduces heat loss to a greater degree than does a single vacuum insulated string. Other advantages include mitigating accelerated heat loss in the event that a single joint fails or loses its vacuum properties and the higher heat loss experienced through the coupling or connectors on each joint. Since the couplings typically do not have vacuum insulated properties these act as hot spots at every connection. However, in a dual vacuum insulated string, the couplings can be staggered to thus limit heat loss through the inner couplings, since these joints will be encased inside a second insulated string.

Advantages of the dual vacuum tubular well design are based on the fact that while it is a passive system, it offers substantially greater insulation than does regular tubing with insulating annular fluid or a single string of VIT. Installation of the additional string of vacuum insulated casing is no different than similarly sized casing and can be handled by existing rig equipment. Current VIC strings are not made in a wide enough bore to provide the second outer string, and thus, VIT in a wider bore may need to be manufactured.

The use of vacuum insulated tubulars is also gaining popularity in deepwater developments for flow conformance. The use of the dual vacuum concept in deepwater wells could also decrease conformance issues. The dual vacuum concept can also be applied in hot environments where heat transfer in the opposite direction is an issue.

Cold drilling fluid can aggravate lost circulation. This cold drilling fluid can be a problem in deep-water wells where the long risers significantly cool the drilling fluid. VIT with offset connections may alleviate this problem.

The inventive well configuration can be used in any well completion wherein heat transfer presents an issue that needs to be addressed. Thus, it can be used in any steam based enhanced oil recovery technology, including SD, CSS, SAGD, ES-SAGD, VAPEX and the like. Further, although contemplated as particularly useful in steam injector wells, the methods can also be applied to production wells and oil pipelines, whenever there is a need to mitigate against heat loss. One particular use is in deepwater developments to prevent wax and hydrate buildup in production wells and delivery pipelines.

In addition, the dual vacuum insulated pipe configuration can be used with any well completion configuration. Referred to as a casing program, the different levels include production casing, intermediate casing, surface casing and conductor casing, including the use of cement, gravel pack, perforated casing or slotted liners, flow control devices, and the like. The configuration could also be used with open hole completions, but such are unlikely to be useful in the unconsolidated oil sands common in Canadian fields.

The invention includes one or more of the following embodiments, in any combination thereof:

- A method of well completion in cold reservoirs; said method comprising completing at least a portion of injector wells and producer wells with concentric dual vacuum insulated piping.
- An improved method of well completion, the method comprising insulating a well with a layer of vacuum insulating piping, the improvement comprising insulating said well with two concentric layers of vacuum insulating tubing (VIT), wherein joints from a first layer of VIT are staggered from joints of a second layer of VIT, and wherein a layer of insulating fluid is provided between said two layers of VIT.
- A hydrocarbon well configuration, the hydrocarbon well configuration comprising an inner layer of VIT casing surrounded by an outer layer of VIT intermediate casing, and wherein couplings from said inner layer are staggered from couplings from said outer layer.
- A method as herein described wherein couplings from said dual vacuum insulated piping are staggered.
- The method wherein said producer wells have concentric dual vacuum insulated piping in at least a permafrost zone.
- The method wherein said injector wells have concentric dual vacuum insulated piping at least until a payzone is reached.
- The method wherein said joints of an inner layer of vacuum insulated piping are staggered from joints of an outer layer of vacuum insulated piping.
- The method wherein a layer of insulative fluid is pumped in between said concentric dual vacuum insulated piping.
- The method wherein said insulative fluid comprises a gas selected from diesel, methane, CO2, N2O, flue gas and air, or combinations thereof.
- The well configuration comprising a layer of insulating fluid between said inner layer and said outer layer.
- The well configuration comprising a third surface casing.
- The well configuration comprising a layer of insulating cement or other insulative fluid outside of said surface casing.
- The well configuration wherein said insulative fluid comprises methane or CO2 or insulative packing fluid.
- The well configuration wherein the cyclic thermal stresses experienced by the outer layer of VIT intermediate casing in contact with the cement outside of said intermediate casing are vastly reduced due to the insulative properties of the inner layer of VIT.

As used herein, the term "steam quality" is defined as the ratio of the mass of water vapor to the total mass of water vapor and liquid of a steam sample. Thus, a steam quality of 0% would be pure liquid, while a quality of 100% would be pure vapor.

By "VIT" or vacuum insulated tubing or similar phrase what is meant is a two layer pipe, with an insulating vacuum between the two layers. The term also includes, however, backfilled VITs having an inert gas in the space between the two layers.

By "VIC" or "VIT intermediate casing" or similar phase, what is meant is a second string of VIT tubing over the inner string. Thus, there are a pair of concentric two layer pipes, each having a vacuum or inert gas filled space.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| ATM | Atmosphere |
| CAPEX | Capitol expenses |
| CPF | Central processing facility |
| CSS | Cyclic steam stimulation |
| ES-SAGD | Expanding solvent SAGD |
| OPEX | Operating expenses |
| OTSG | Once-through steam generator |
| SAGD | Steam-assisted gravity drainage |
| SD | Steam drive |
| TDS | Total dissolved solids |
| VAPEX | Vapor extraction |
| VIT | Vacuum insulated tubing |
| VIC | VIT intermediate casing |

DETAILED DESCRIPTION

Figure 1A:
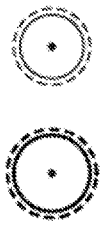
FIG. 1A shows the fully thawed (solid line) and partially thawed (dotted outline) bulbs surrounding typical injection and producer wells at 3 years.
Figure 1B:
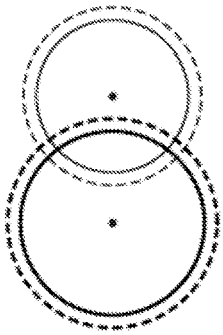
FIG. 1B shows the fully thawed (solid line) and partially thawed (dotted outline) bulbs surrounding typical injection and producer wells at 18 years. Thaw bulbs can cause the ground to subside and loss of equipment or even an entire well.
Figure 1C:
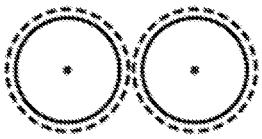
FIG. 1C shows the fully thawed (solid line) and partially thawed (dotted outline) bulbs surrounding VIT and dual VIT VIC thaw bulbs at 18 years.
Figure 1C:
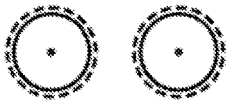
Figure 2:
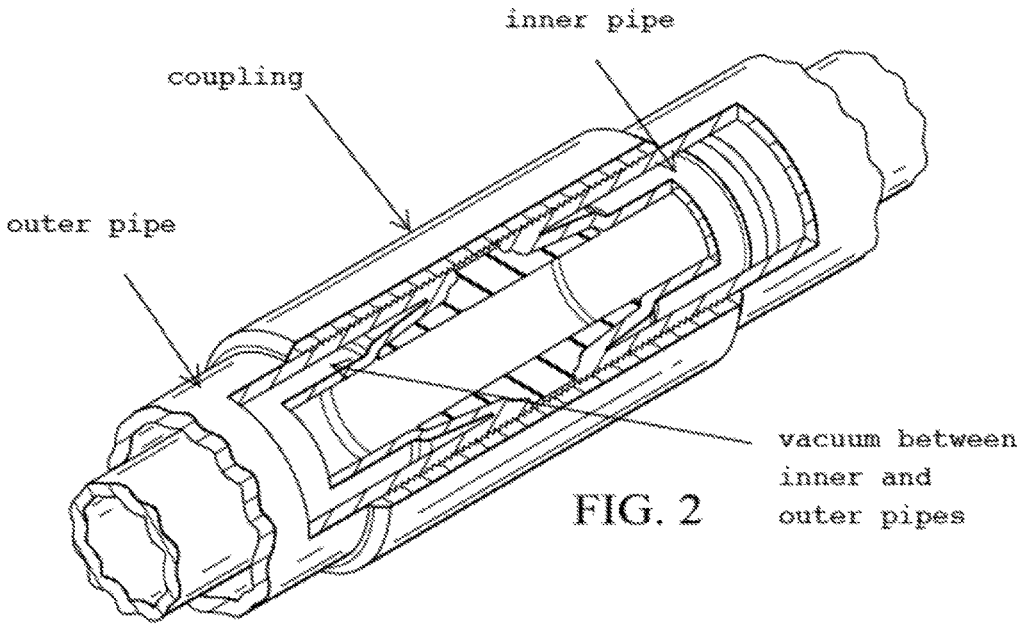
FIG. 2 shows a typical vacuum insulated tubing or VIT.

The disclosure provides a novel method, apparatus and system for reducing heat losses in oil wells, and can be advantageously applied to any oil recovery, but is especially beneficial in Artic or deepwater and other very cold reservoirs where heat loss should be minimized.

Generally speaking, the disclosure provides a dual insulative tubing system, wherein at least two concentric vacuum insulative pipes are used, providing two concentric vacuum (or inert gas filled) layers to insulate against heat loss. If the joints for each layer are staggered, heat loss at the joints can also be minimized.

An additional layer of insulation can be had if an insulative gas, such as methane, is pumped down in between the two layers. Other thermally insulative gas options include CO2, N2O, flue gas and air.

Traditional insulative layers can also be combined with the dual VIT-VIC well design, including the use of insulative gels and liquids, methane, diesel, thermal cement, insulating packer fluids such as N-SOLATE™ from Halliburton or ISOTHERM™ or SAFETHERM from Schlumberger, Glass microsphere such as 3M's Glass Bubbles and Water-Superabsorbent Polymers from Baker Hughes, and the like. In addition to enhanced well insulation, other mitigation options to reduce thaw subsidence driven well deformations can be combined with the methods and well designs herein, including increased well spacing, reduced well operating temperatures, and various combinations of the above options.

The dual vacuum insulative tubing can be used wherever heat loss is a problem, and in particular can be used in the permafrost zone of both injector and producer wells. Further, injector wells can be have dual vacuum insulative tubing along their entire pre-payzone length, thus delivering maximal steam quality to the payzone.

The VIT can be of any design known in the art or to be developed. Exemplary VITs are described in U.S. Pat. No. 3,720,267, U.S. Pat. No. 3,397,745, U.S. Pat. No. 4,512,721, U.S. Pat. No. 7,677,272, U.S. Pat. No. 7,854,236. VIT is also commercially available, e.g., from Industrial Technology Management (CA), who sells a variety of tubing sizes up to 4.5 inches and with varying degrees of thermal protection, including inert gas back-filled VIT. Shengli Petroleum has VIT up to 5 inches. Isothermica and DoubleOil Petroleum Services Co. are additional suppliers. Discussions are in progress with manufacturers to have VIT prepared in a bore large enough for VIC use in field testing in the Surmont and/or Ugnu reservoirs.

A vacuum is an ideal insulator. Creating a vacuum between the two pipes minimizes both gas convection and conduction heat transfer between the inner and outer pipes. Radiative heat transfer is minimized by providing a reflective blanket of insulation over the outside diameter of the inner tube. The inner and outer pipes are welded together, after which the vacuum is created, and the tubing sealed.

Once a vacuum has been established within the annulus between the two pipes, it must be maintained. There is a tendency for molecules to be desorbed from the metal matrix, but also during subsequent oil production, corrosion of the vacuum insulated tubing (VIT) string will generate hydrogen. Some of this hydrogen will permeate into the vacuum annulus, reducing it insulating ability.

The problem of vacuum loss can be solved with "getter." Essentially, getter captures hydrogen, and traps it via chemical bonding. There are two types of getter used. A non-evaporable getters works by surface adsorption followed by bulk diffusion into the getter matrix. An organic getter absorbs hydrogen through a dehydrogenation reaction. The getter is typically purchased as granules or tablets, and is added during the fabrication process. The multilayer and gettered high vacuum insulated tubing systems (VIT) substantially improve thermal performance having conductivity values in the range of 0.0018-0.0023 Btu/Hr-Ft-° F. (0.003-0.004 w/mK).

Another possible solution is to backfill the vacuum. The first insulated tubing consisted of an Argon gas backfilled insulating system having thermal conductivity values in the range of 0.015 Btu/Hr-Ft-° F. (0.026 w/mK).

Figure 3:
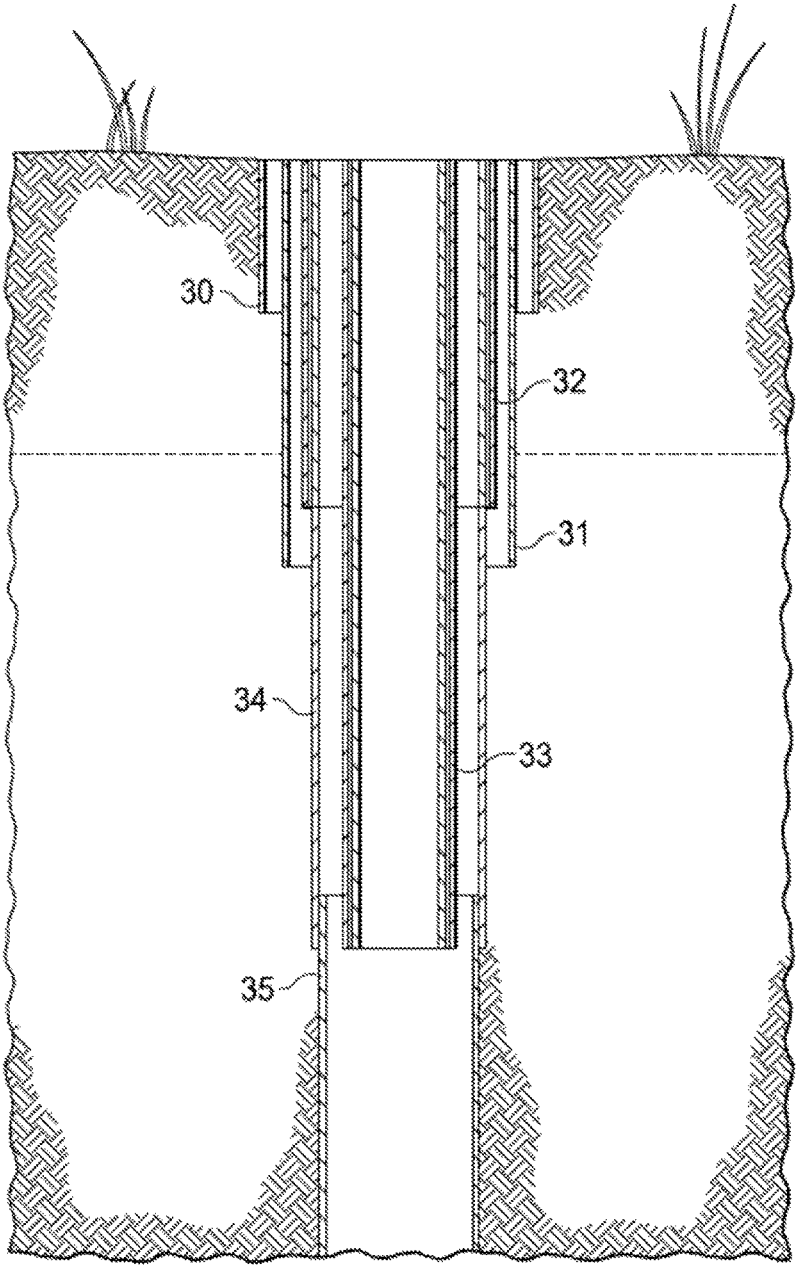
FIG. 3 illustrates one exemplary well completion scenario.

An illustration of an exemplary completion is found in FIG. 3. In FIG. 3 an injection well is completed of using dual VIT 32 and VIC 33 configuration, wherein the VIC tubing is 13⅜"×9⅝" and the VIT tubing is 6⅝"×4½" VIT. 16 inch surface casing 31, and a 20" insulated conductor 30 will complete the well. The top will be cemented, and diesel will be used in the annulus (not shown). At the pay zone, the well deviates to be horizontal (not shown) and the 7" slotted liner 35 allows steam injection into the pay. A production well can be similarly completed. As is shown, the dual VIT and VIC configuration is used at least through the permafrost zone (see dotted line). Thereafter, either single VIT or double VIT can be used, depending on the economics and reservoir needs.

Figure 4A:
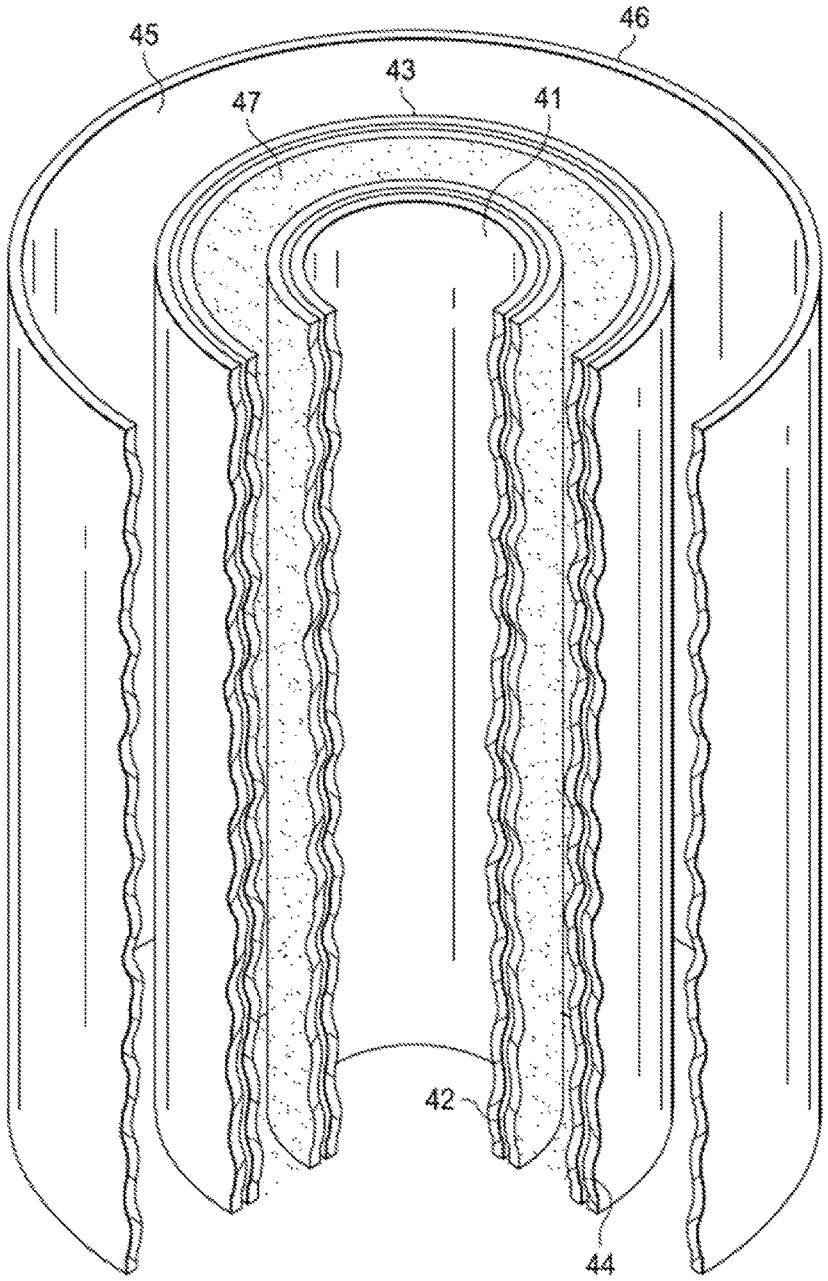
FIG. 4A shows a cut-away length of exemplary dual VIT and VIC configurations.
Figure 4B:
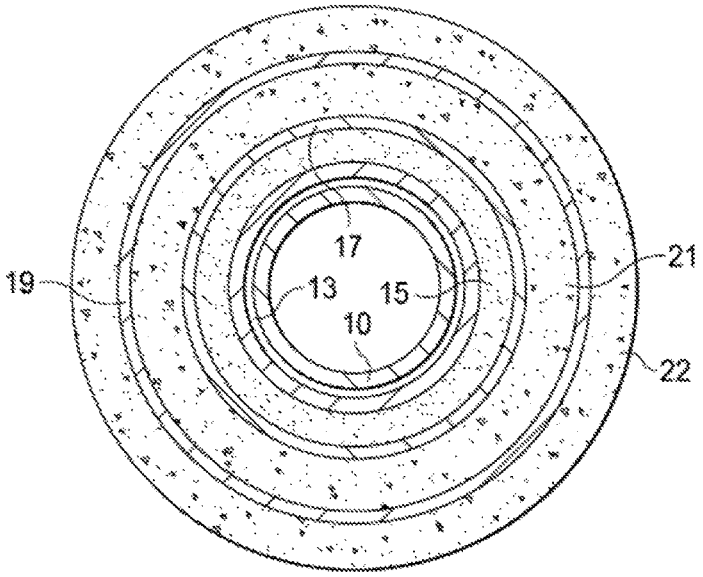
FIG. 4B shows a cross-section of a single VIC configuration.
Figure 4C:
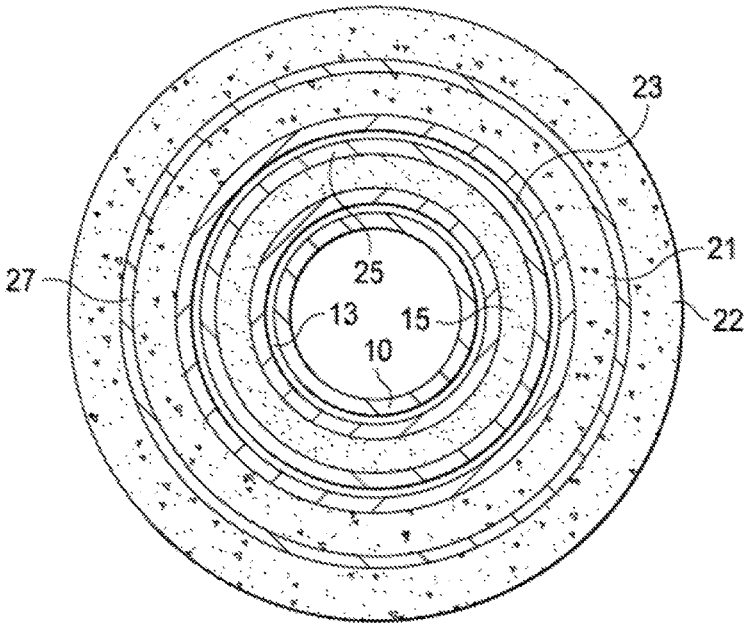
FIG. 4C shows a cross-section of an exemplary dual VIT and VIC configurations.

Exemplary tubing arrangements are found in FIG. 4A-C. FIG. 4A shows a cut away of a dual VIT 41 and VIC 43 well in the permafrost region, each having a layer of vacuum 42, 44 respectively therebetween the double walls of the insulated pipes. Surface casing 46 contains the concentric double walled pipes, and a thermal barrier fluid 45, 47 is between the surface casing 46 and VIC layer 43, and/or between the VIC 43 and VIT 47. Thermal barrier fluid 45, 47 can be diesel, methane, cement, or any other suitable heat sink material.

FIG. 4B shows a single VIT 10 with vacuum layer 13. Intermediate casing 17 surrounds the VIT 10 and a layer of methane gas 15 is therebetween. The well is completed with surface casing 19 and cement 21, 22.

FIG. 4C shows a dual VIT 10 and VIC 25 with methane gas 15 therebetween, and each having a vacuum layer 13, 23. Surface casing 27 and cement layers 21, 22 complete the well.

Figure 5A:
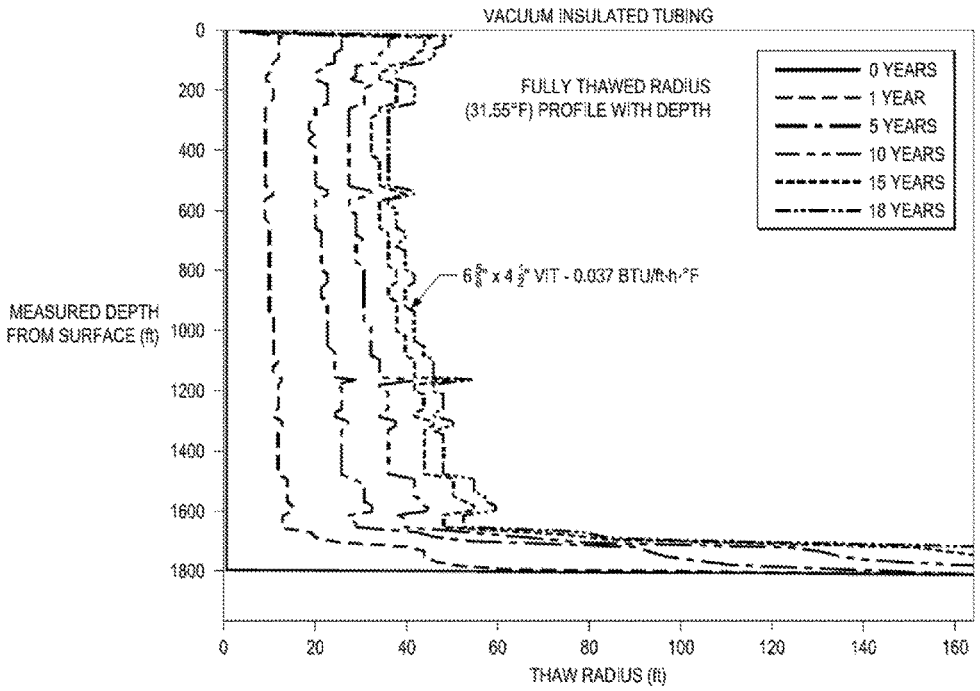
FIG. 5A shows depth vs. thaw radius with VIT. For comparison.
Figure 5B:
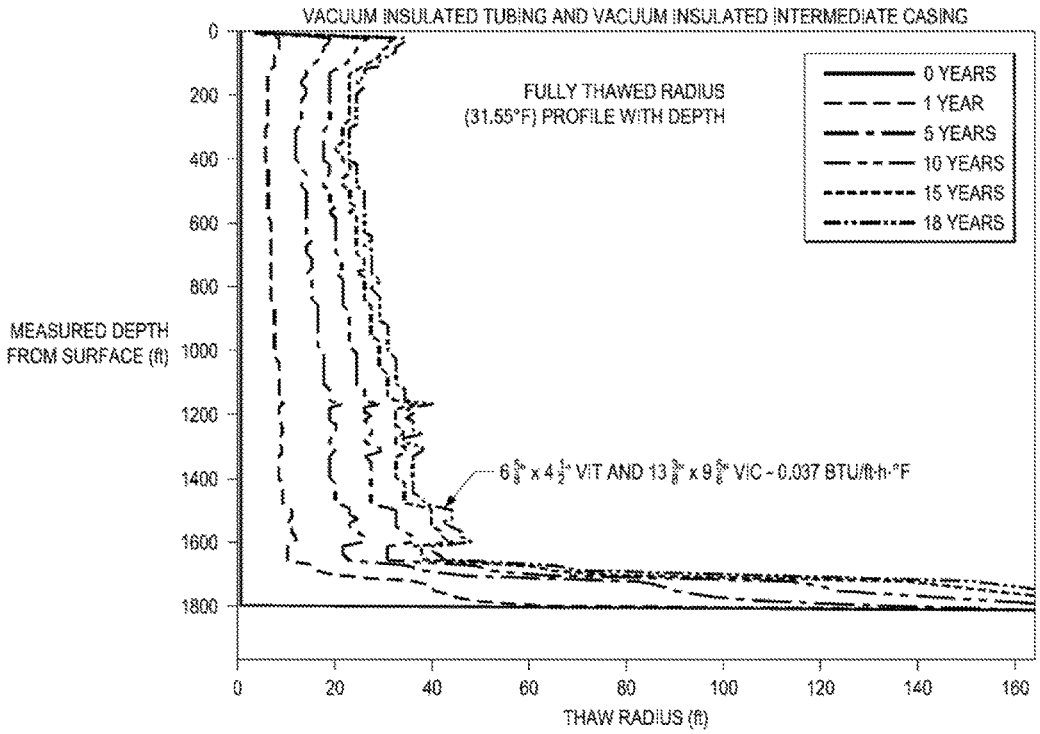
FIG. 5B shows measured depth vs. thaw radius with dual VIT+VIC wells. As can be seen, the dual VIT and VIC configuration slows the growth of thaw bulb radii significantly.

FIG. 5A-B shows the results of Thermal-Hydraulic Modeling studies conducting using C-FERS transient finite difference (FD) model, wherein the model features included temperature dependent thermal resistance for each annulus, fully dependent ground properties, including latent heat, and full thermo-hydraulics to update fluid temperatures along the permafrost region or the whole well.

As can be seen in FIG. 5B, the dual VIT and VIC casing was more effective that VIT casing alone (FIG. 5A), decreasing the thaw radius about 20-30% at 18 years. Further, the heat transfer was reduced to 0.02-0.05 BTU/ft·h·° F. (from interior of the inner string to the exterior of the outer string). Therefore, the modeling predicts that the method will be effective in reducing heat loss. TubeAlloy quotes a K value of 0.02 BTU/ft·h·° F. for the body of the tubing joint excluding the coupling.

Figure 6A:
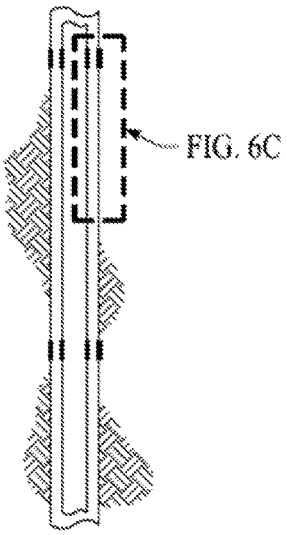
FIG. 6A shows a nested well with aligned coupling.
Figure 6B:
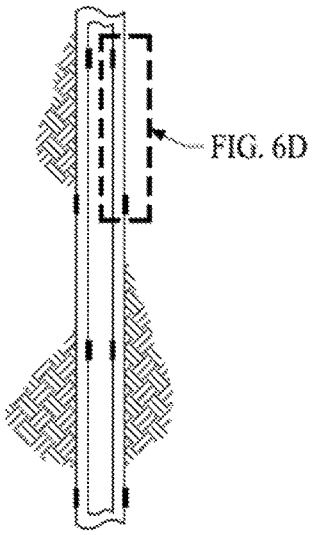
FIG. 6B shows a nested well with staggered or offset couplings.
Figure 6C:
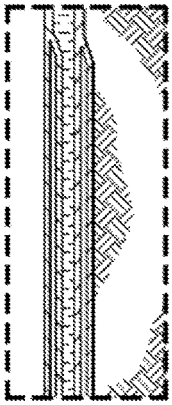
FIG. 6C inset of FIG. 6A is shown in greater detail a nested well with aligned coupling.
Figure 6D:
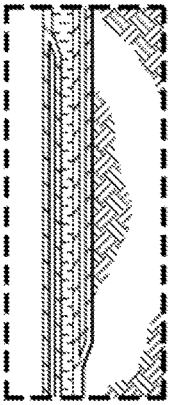
FIG. 6D inset of FIG. 6B is shown in greater detail a nested well with staggered or offset couplings.
Figure 7:
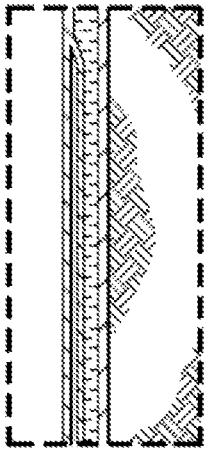
FIG. 7 shows a traditional VIT configuration.
Figure 8:
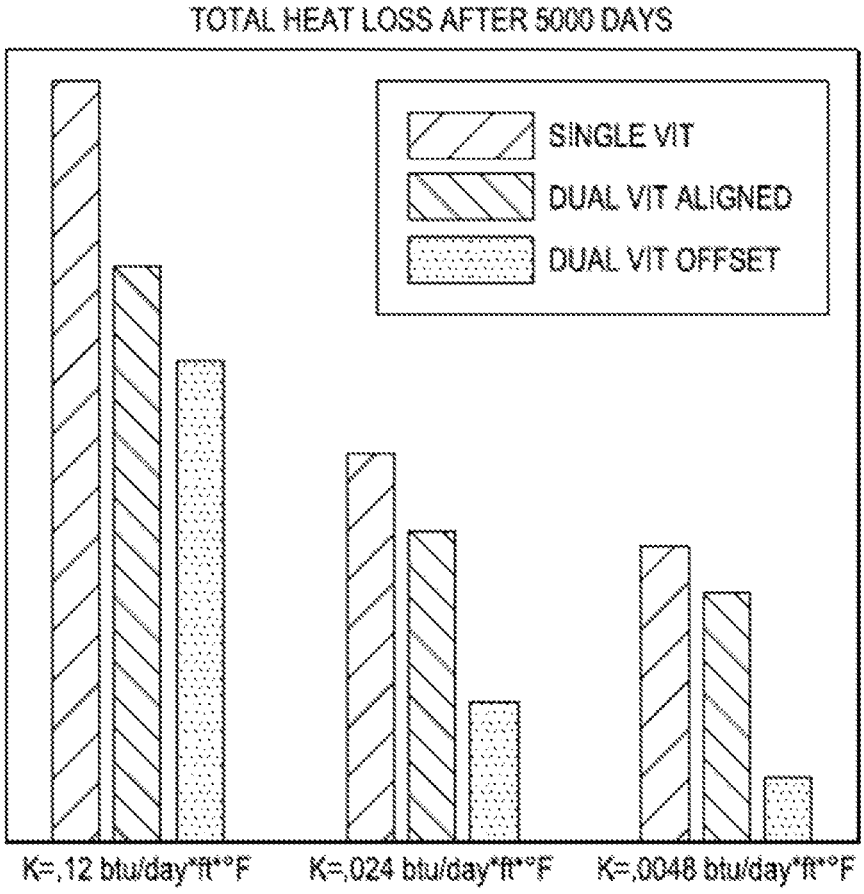
FIG. 8 shows the heat loss modeling results of the wells of FIG. 6A, FIG. 6B and FIG. 7 assuming three five fold varying levels of thermal conductivity (k), which is the property of a material to conduct heat. In Imperial units, thermal conductivity is measured in BTU/(hr·ft·° F.).

In FIG. 6A-D a well is shown in schematic. In FIG. 6A the couplings are aligned. See also detail at FIG. 6C. In FIG. 6B, the couplings are staggered, as in the detail at FIG. 6D. FIG. 7 shows a prior art well, using only a single VIT string. In FIG. 8, these three well types are modeled for heat loss, assuming three different levels of thermal conductivity (K). In the heat loss bar graphs it can be seen that decreasing the conductivity five fold has less effect on heat loss than doubling the vacuum tubing string and staggering the couplings. Since the estimated cost of the VIC is 3× the cost of typical casing, it is more cost effective to use dual vacuum tubing than to decrease the thermal conductivity significantly.

The following documents are incorporated by reference in their entirety for all purposes:

U.S. Pat. No. 3,397,745, Owens and Owens, "Vacuum-insulated steam-injection system for oil wells," (1968);

U.S. Pat. No. 3,720,267, Allen, et al., "Well Production Method for Permafrost Zones" (1973);

U.S. Pat. No. 4,512,721, Ayres, et al., "Vacuum insulated stem injection tubing" (1985);

U.S. Pat. No. 7,677,272, Hickman and Cannon, "Insulator apparatus for vacuum insulated tubing" (2006); and U.S. Pat. No. 7,854,236, Jibb, et al., "Vacuum insulated piping assembly method" (2008).

What is claimed is:

1. A method of well completion in cold reservoirs, said method comprising completing at least a portion of injector wells and producer wells with concentric dual vacuum insulated piping, said concentric dual vacuum insulated piping comprising an outer vacuum insulated piping surrounding an inner vacuum insulated piping, and further comprising couplings surrounding said outer vacuum insulated piping that are staggered from couplings surrounding said inner vacuum insulated piping, wherein said dual vacuum insulated piping mitigates heat loss more than single vacuum insulated piping, wherein said dual vacuum insulated piping with staggered coupling mitigates heat loss more than dual vacuum insulated piping without staggered couplings;

wherein each vacuum insulated piping has two nested pipes with a vacuum therebetween.

2. The method of claim 1, wherein said producer wells have concentric dual vacuum insulated piping in at least a permafrost zone.

3. The method of claim 1, wherein said injector wells have concentric dual vacuum insulated piping at least until a payzone is reached.

4. The method of claim 1, wherein the vacuum insulated piping has an inner layer and an outer layer each having joints thereon, and wherein said joints of the inner layer of the vacuum insulated piping are staggered from said joints of the outer layer of the vacuum insulated piping.

5. The method of claim 1, wherein a layer of insulative fluid is pumped in a space between said inner vacuum insulated piping and said outer vacuum insulated piping.

6. The method of claim 5, wherein said insulative fluid comprises a gas selected from methane, CO2, N2O, flue gas and air.

7. The method of claim 5, wherein said insulative fluid comprises methane.

8. The method of claim 5, wherein said insulative fluid comprises CO2.

9. A method of well completion, the method comprising insulating a well with two concentric layers of vacuum insulating tubing (VIT), wherein joints from a first layer of VIT are staggered from joints of a second layer of VIT, and wherein a layer of insulating fluid is provided between said two concentric layers of VIT;

wherein each VIT has two nested pipes with a vacuum therebetween.

10. A hydrocarbon well configuration, the hydrocarbon well configuration comprising an inner layer of vacuum insulating tubing (VIT), surrounded by an outer layer of VIT, and wherein couplings from said inner layer of VIT are staggered from couplings from said outer layer of VIT;

wherein each VIT has two nested pipes with a vacuum therebetween.

11. The hydrocarbon well configuration of claim 10, further comprising a layer of insulating fluid between said inner layer of VIT and said outer layer of VIT.

12. The hydrocarbon well configuration of claim 11, wherein said insulative fluid comprises methane.

13. The hydrocarbon well configuration of claim 11, wherein said insulative fluid comprises CO2.

14. The hydrocarbon well configuration of claim 11, wherein said insulative fluid comprises insulative packing fluid.

15. The hydrocarbon well configuration of claim 10, further comprising a surface casing.

16. The hydrocarbon well configuration of claim 15, further comprising a layer of insulating cement outside of said surface casing.

17. The hydrocarbon well configuration of claim 10, further comprising cement outside and in contact with the outer layer of VIT, which has cyclic thermal stresses are limited due to the insulative properties of the inner layer of VIT.

* * * * *